United States Patent [19]

Lopata et al.

[11] Patent Number: 4,900,977

[45] Date of Patent: Feb. 13, 1990

[54] SUPPORT SYSTEM FOR FLAT CRT TENSION MASK

[75] Inventors: Donald J. Lopata, Horseheads; Robert L. Mathew, Elmira, both of N.Y.

[73] Assignee: Corning Incorporated, Corning, N.Y.

[21] Appl. No.: 177,338

[22] Filed: Apr. 4, 1988

[51] Int. Cl.[4] ..... H01J 29/07; H01J 29/86

[52] U.S. Cl. ..... 313/407; 313/408; 313/482; 220/2.1 A

[58] Field of Search ..... 313/407, 408, 482; 220/2.1 A

[56] References Cited

U.S. PATENT DOCUMENTS

| | | | |
|---|---|---|---|
| 2,625,734 | 1/1953 | Law . | |
| 2,813,213 | 11/1957 | Cramer et al. . | |
| 3,284,655 | 11/1966 | Oess . | |
| 3,638,063 | 1/1972 | Tachikawa et al. | 313/269 X |
| 3,894,321 | 7/1975 | Moore | 313/482 X |
| 4,069,567 | 1/1978 | Schwartz . | |
| 4,547,696 | 10/1985 | Strauss | 313/407 |
| 4,593,224 | 6/1986 | Palac | 313/407 X |
| 4,595,857 | 6/1986 | Rowe et al. | 313/407 |
| 4,716,334 | 12/1987 | Fendley et al. | 313/407 |

FOREIGN PATENT DOCUMENTS

| | | | |
|---|---|---|---|
| 1070624 | 1/1984 | U.S.S.R. | 313/408 |

*Primary Examiner*—Palmer C. DeMeo

*Attorney, Agent, or Firm*—Burton R. Turner; Richard N. Wardell

[57] ABSTRACT

A reference and support system for a flat CRT tension shadow mask is disclosed which includes a support frame which is frit sealed or shink fitted onto a peripheral surface surrounding a target area of a flat panel. An upper edge of the support frame is finished so as to provide the desired Q-spacing between the target area and the top of the support frame. Alignment holes are drilled in the sidewalls of the support frame at a given distance from the upper edge to form a reference plane relative thereto. A temporary fixture has a tensioned mask initially secured thereto and is provided with a plurality of pins extending through sidewalls thereof at a given distance from an upper reference surface such that the pins engage the holes in the support frame and precisely position the shadow mask in the plane of the top edge of the support surface. Such fixture may be utilized for not only applying the various phosphors to the target area, but also for finally positioning the tension shadow mask on the support frame so that it may be welded thereto and the temporary frame removed.

6 Claims, 2 Drawing Sheets

SUPPORT SYSTEM FOR FLAT CRT TENSION MASK

BACKGROUND OF THE INVENTION

This invention relates to a mask support system for a color cathode ray tube having a flat faceplate, and to a system for indexing or referencing a flat tension shadow mask for insertion and removal during the panel screening process, and for repositioning the mask for welding to a permanent metal support frame.

A shadow mask or color selection electrode is a device which is disposed adjacent the luminescent phosphor screen that forms the target electrode of a color cathode ray tube, to control the landing pattern of one or more electron beams as they are swept across the screen. The shadow mask achieves color selection by partially shadowing the surface of the screen from scanning electron beams, permitting access to selected elemental phosphor areas by those beams. The most common type of color selection electrode used in color television receivers today is the conventional nontensed curved type.

There is a tendency, however, for the conventional shadow mask utilized in color picture tubes to distort or buckle in the shape of a dome in those areas wherein concentrated beams of high brightness tend to heat the mask and cause localized distortion. The general practice of positioning the mask at an assigned location relative to the phosphor screen, by suspending it from three pre-selected points disposed about the periphery of the tube's face panel, accommodates overall thermal expansion of the mask, but does not resolve the above-described localized doming problem caused by concentrated heating in localized areas of the mask.

Tensioned shadow masks have been utilized with both the common cylindrical faceplate CRT and the newer flat faceplate CRT. With respect to the former, U.S. Pat. No. 3,638,063 discloses the use of a shadow mask in the form of a grid tensed across a spring frame suspended conventionally within the tube. The mask supporting frame is mechanically stressed, such as by compressing it prior to attaching the shadow mask thereto. Upon release of the compression force, restoration forces in the frame establish tension in the mask. Thus, the mask, while under tension, will not dome and retains its desired configuration during normal conditions. However, under extreme tube operating conditions, electron bombardment of the mask can cause a series of grids of the mask to relax and cause color impurities.

With respect to the latter, or flat faceplate construction, U.S. Pat. Nos. 4,547,696 and 4,593,224, set forth different forms of tension mask registration and support systems. The system disclosed in U.S. Pat. No. 4,547,696 requires the milling of precision cavities in both sealing surfaces of a glass mask support frame, in the sealing land of the faceplate, and in the sealing land of the funnel. In addition, a stabilizing or stiffening member must be frit sealed to the mask support frame in order to avoid any bending or flexing moment applied to the support frame by virtue of the tension forces in the mask. Finally, a plurality of spherical balls are positioned within the grooves between adjacent surfaces of the support frame and the faceplate to provide a registration and indexing means, usable when screening the pattern of elemental phosphor deposits upon the target surface of the panel. However, each time that the panel is removed from the support ring for applying the different phosphors, it would be imperative that each spherical ball be replaced in its original groove in order to avoid any disorientation which might be occassioned by variation in the ball sizes. The same requirement is true when finally frit sealing the support frame to the panel, wherein the frit material could jeopardize the Q-spacing previously relied upon in the lighthousing of the applied phosphor deposits.

The U.S. Pat. No. 4,593,224 discloses a rather complex electrode assembly including an upper glass frame member, a lower glass frame member, a temporary metal mount having a plurality of nuts welded thereto with threaded spindles extending therethrough, and V-grooves milled into the sealing lands of the glass faceplate and the funnel for receiving metal alloy bosses formed in the upper and lower frame members. A mask is drawn taughtly across the opening of the temporary metal mount and secured thereto by brazing or welding. A plurality of nuts are brazed or welded to the temporary metal mount, and a spindle is threaded through each such nut. The temporary metal mounting frame is then positioned over the lower glass frame member and the upper glass frame member is positioned upon the lower member with the mask element held therebetween. The upper and lower frame members are then frit sealed to the shadow mask in an oven, and the mask is thermally tensioned in the process. A plurality of alignment V-grooves are milled into the sealing land of the glass faceplate, and a plurality of metal alloy bosses are formed in a lower sealing land of the lower frame member. Accordingly, the electrode assembly, without the temporary metal mount, is then utilized for depositing the elemental phosphors on the target area of the faceplate by aligning the metal alloy bosses with the V-grooves in the faceplate. Finally, the electrode assembly and the faceplate are frit sealed together utilizing the same alignment system, however, the Q-space could possibly be varied by the thickness of the frit between the electrode assembly and the faceplate from that utilized during the deposition of the phosphors. In addition, the mask is thermally distorted upon the second heating, required for sealing the electrode assembly to the faceplate, and upon cooling there is a possibility of some residual distortion.

An earlier example of a tensioned shadow mask for use in a color television CRT is described in U.S. Pat. No. 2,625,734. The tensed mask described therein was created by resort to a process called "hot-blocking". The practice was to insert a flat mask between a pair of frames which loosely received the mask. A series of tapped screws joining the two frames served to captivate the mask when the screws were subsequently drawn-down. The loosely assembled frame and mask was then subjected to a heat cycle by positioning heated platens adjacent the mask to heat and thereby expand it. The frame, however, was kept at room temperature. When the mask attained a desired expansion, the frame screws were tightened to captivate the mask in its expanded state. The heating platens were then removed. Upon cooling down to room temperature, the mask was maintained under tension by the frame. The resultant assembly was then mounted inside the tube adjacent the phosphor screen.

U.S. Pat. No. 2,813,213 describes a cathode ray tube which employs a switching grid mounted adjacent the phosphor screen. A taught wire grid is sealed in the tube envelope wall and an external frame is utilized to relieve the tension forces applied by the taught grid to the glass wall of the tube.

U.S. Pat. No. 3,284,655 is concerned with a direct viewing storage cathode ray tube employing a mesh storage target which is supported in a plane perpendicular to the axis of the tube. The mesh target comprises a storage surface capable of retaining a charge pattern which, in turn, controls the passage therethrough of a stream of electrons. From a structural standpoint, it is proposed that the mesh storage screen be affixed to a circumferential ring that is disposed across the open end of the envelope member. One end of the ring is in contact with the edge of the envelope member which has a coating of glass frit applied thereon. The end wall of another envelope member, also coated with frit, is placed in contact with the other side of the ring so that the end walls of the envelope members now abut both sides of the ring. Thereafter, this assembly is frit sealed to secure the ring and mesh target within the tube, however, the mesh screen is not said to be subject to tension forces, or is such screen a customary color selection electrode.

U.S. Pat. No. 3,894,321 is directed to a method for processing a color electrode ray tube having a thin foil mask sealed directly to the bulb. Included in this disclosure is a description of the sealing of a foil mask between the juncture of the skirt of the faceplate and the funnel. The foil mask is noted as having a greater thermal coefficient of expansion than that of the glass to which it is mounted, hence following a heating and cooling cycle in which the mask is cemented at the funnel-faceplate juncture, the greater shrinkage of the mask upon cooling places it under tension. The mask is shown to have two or more alignment holes near the corners of the mask which mate with alignment nipples in the faceplate. The nipples pass through the alignment holes to fit into recesses in the funnel. In another embodiment, the front panel is shown as having an inner ledge forming a continuous path around the tube, the top surface of which is a Q-distance away from the faceplate for receiving the foil mask such that the mask is sealed within the tube envelope. An embodiment is also shown in which the faceplate is skirtless and essentially flat.

U.S. Pat. No. 4,069,567 discloses a method of installing a shadow mask, such that under normal tube operating conditions, the mask is held by a holder in a hypertensed state, and is thus capable of withstanding an unusually high electron beam bombardment before relaxing. Preferrably, the electrode is of a material which has a significantly higher coefficient of thermal expansion than that of its holder. The electrode and the holder may be externally heated together, such as by an oven, while the electrode is tensed. Simultaneously therewith selective heating is applied, such that the holder and electrode are caused to thermally expand, but the electrode by a greater amount. The electrode is affixed to the holder, and finally the electrode and holder are cooled to room temperature so as to hypertense the electrode due to the greater coefficient of thermal expansion and temperature fall of the electrode than that of the holder.

Finally, U.S. Pat. No. 4,595,857, which is similar to previously discussed U.S. Pat. No. 4,547,696, relates to a structure wherein the mask is sized and the frame is so adapted such that the mask is supported completely within the tube enclosure on a peripheral frame surface facing away from the faceplate.

In order to overcome the problems and complexities with the above-noted tension mask systems of the prior art, it is an object of the present invention to provide an accurate and simple positioning system for a tension mask in a CRT by minimizing the number of parts required and reducing costly machining and process steps.

SUMMARY OF THE INVENTION

In its simplest form, the present invention sets forth a new concept in providing a reference and support system for flat CRT shadow masks by shrink fitting or frit sealing a support frame to a step or groove formed in the back surface of a faceplate, and utilizing spaced holes or spheres for precisely and repeatedly registerably positioning a tension mask on said support frame with a predetermined Q-spacing. A tensioned shadow mask is supported in a temporary frame having reference units which precisely engage the holes or spheres of the support frame so that the temporary tension mask assembly can be removed and precisely reinserted on the support frame for applying the required phosphors during the screening process, and for accurately relocating the mask on the frame for welding the mask to the support frame.

DESCRIPTION OF THE PREFERRED EMBODIMENTS

Figure 1:
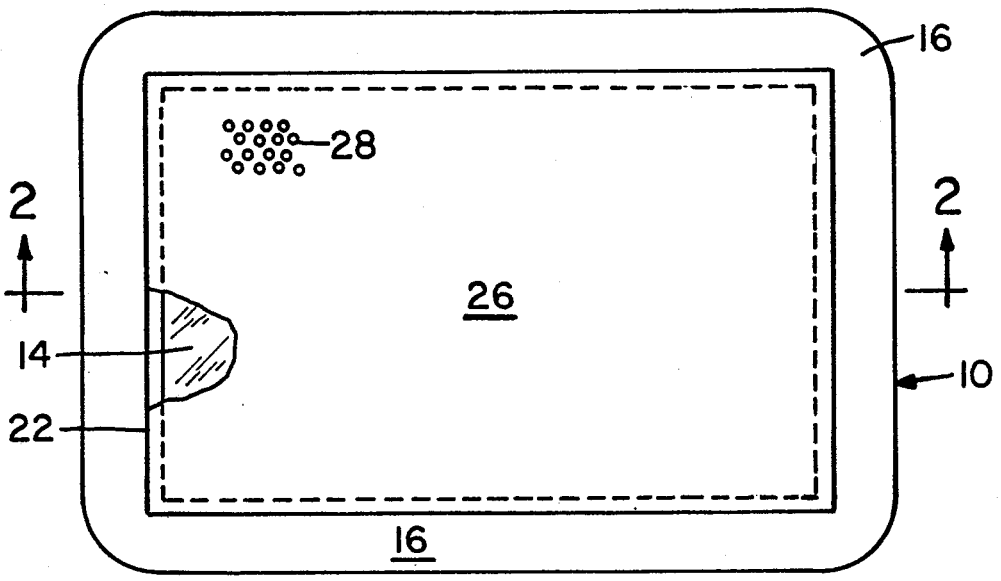
FIG. 1 is a plan view of a CRT panel and mask assembly including a faceplate having a tension shadow mask secured thereto in accordance with the present invention.
Figure 2:
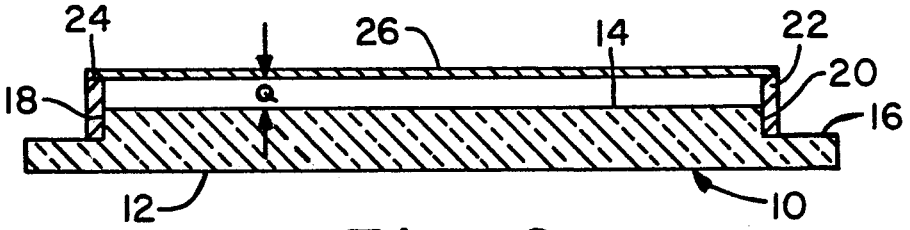
FIG. 2 is a cross-sectional view in elevation taken along line 2—2 of FIG. 1.

Referring now to FIGS. 1 and 2, a flat panel or faceplate 10 is shown having an outer surface 12 and an inner surface or target area 14 bounded by a sealing land 16. The faceplate 10 is designed with a step or groove 18 providing a peripheral vertical surface 20 against which a metal support frame or band 22 is snuggly positioned. The support frame 22 has an upper bonding surface 24 to which a pretensioned flat shadow mask 26 may be welded with a desired Q-spacing between the mask 26 and the target area 14 of faceplate 10. As shown, the shadow mask may be provided with a predetermined array or pattern of apertures 28 which may be triads of minute circular holes or, as now favored in the state-of-the color television art, a myriad of elongated narrow slots disposed perpendicular to the major axis of the shadow mask.

Figure 2A:
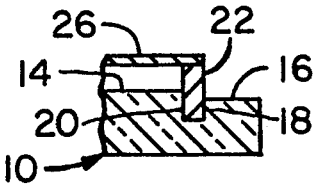
FIG. 2*a* is a fragmental elevational view in section, similar to FIG. 2, but showing a further embodiment of the invention.

FIG. 2*a* illustrates an embodiment wherein the metal support frame 22 is positioned adjacent a vertical surface 20 formed by a groove 18 in the inner surface of the faceplate 10. Thus, the target area 14 and the sealing land 16 may in fact be in the same plane as shown, if desired. In contrast, the support frame 22 as shown in FIG. 2 is positioned against a vertical surface 20, formed by a step 18 between the sealing land 16 and the target area 14.

Figure 3:
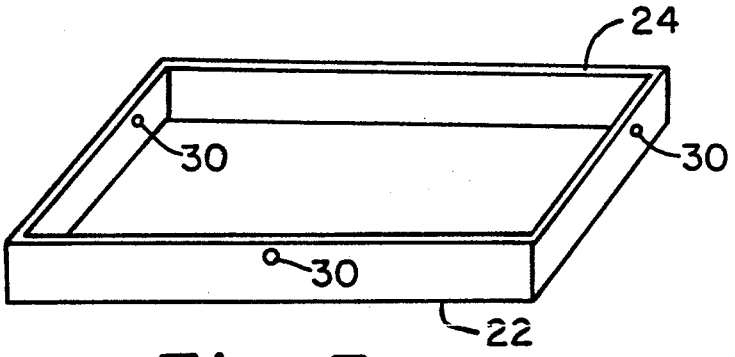
FIG. 3 is a perspective view of a support frame utilized in the present alignment system.
Figure 3A:
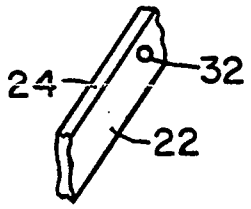
FIG. 3*a* is a fragmental view of an alternate support frame.
Figure 4:
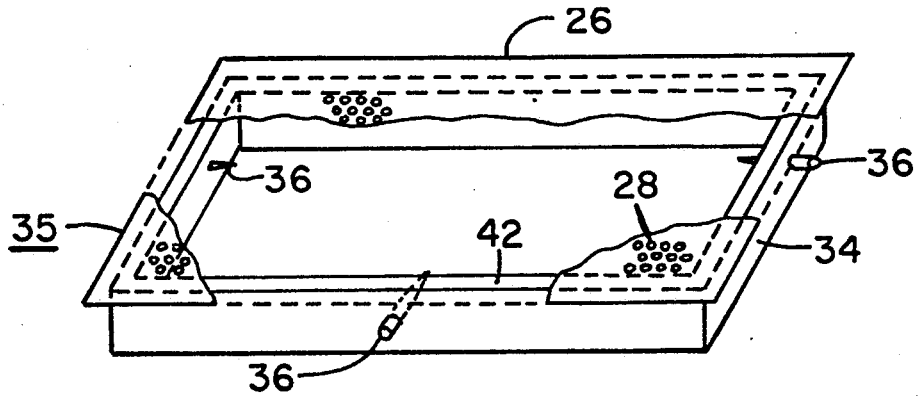
FIG. 4 is a perspective view of a temporary support frame utilized in the reference system of the present invention, showing an aperture mask, partially cut away, stretched across a top surface thereof.
Figure 5:
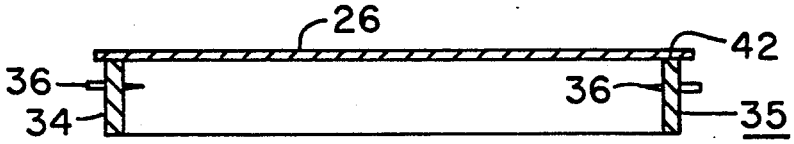
FIG. 5 is a cross-sectional view in elevation of the temporary frame shown in FIG. 4.

Referring now to FIG. 3, the metal support frame or band 22 is shown provided with a plurality of three spaced-apart holes 30 formed through adjacent sidewalls of the frame. The upper bonding surface is first ground or machined flat after being secured to the panel, to provide the proper Q-spacing between the upper surface 24 of the support frame 22 and the target surface 14 of the panel 10. The reference holes 30 are located an equal vertical distance below the upper surface 24, so as to establish a reference plane for a temporary location frame or fixture. As an alternative, a plurality of three spheres 32 may be welded to the adjacent sidewalls of the support frame 22, at a predetermined equal distance below the finished upper surface 24, to provide the reference plane, as shown in FIG. 3*a*.

Figure 6:
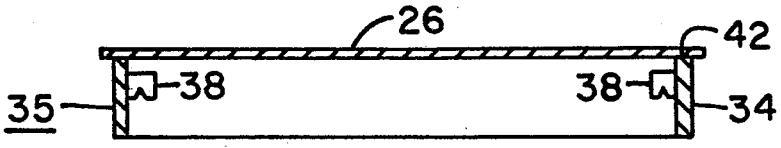
FIG. 6 is a cross-sectional view in elevation of a further embodiment of the temporary frame.
Figure 6A:
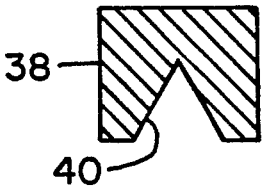
FIG. 6*a* is an enlarged cross-sectional view of a V-block form of reference unit.

As shown in FIGS. 4–6*a*, a temporary frame or fixture 34 is shown having a plurality of three reference units, either in the form of spring mounted locating pins 36 to engage the location holes 30 of the support frame 22, or in the form of V-blocks 38 to engage the reference spheres 32 welded to the outer surface of the support frame 22. As shown in FIG. 6*a*, the V-blocks 38 have a conical V-shaped recess 40 for accurately locating the spheres 32 so as to position the temporary fixture 34 in the desired plane referenced by the spheres 32. In a like manner, the spring mounted locating pins 36 accurately engage the reference locating holes 30 formed in the support frame 22 for correctly positioning the temporary fixture 34 in the reference plane. The pretensioned flat shadow mask 26 is shown temporarily secured to the upper reference surface 42 of the temporary fixture 34, forming tension shadow mask assembly 35.

In operation, a faceplate 10 is provided having a step or groove 18 forming a vertical surface 20. A metal support band or frame 22 is fabricated so that in its final position, it will be in a snug shrink fit to the vertical surface 20 of the panel 10. In order to shrink fit the band onto the panel, the band is heated to expand its perimeter, and then applied to the glass panel and allowed to cool and contract so as to form a shrink fit about the vertical surface 20. As such, the band may also function as an effective integral implosion protection system. If desired, the support frame or band 22 may be frit sealed to, or mechanically stretched on, the step or groove in the glass panel 10.

The upper surface 24 of the frame 22 is ground or machined to establish a proper Q-spacing dimension between the upper surface 24 of the band and the target area 14 of the panel 10, which has been previously ground flat. A plurality of three reference holes, located equally spaced below the upper surface 24 of the support frame 22, are drilled through adjacent sidewalls of the support frame to form a reference plane relative to such surface. Alternately, a plurality of spheres or balls 32, also located equally below the upper surface 24 of the support frame 22, may be welded to the outer surface of adjacent walls of the frame member 22 to form such reference plane.

A temporary frame or fixture 34 is provided having a planar upper reference surface 42. A plurality of three spring-loaded locating pins are mounted through adjacent wall portions of the temporary fixture at a given distance relative to the upper reference surface of the temporary fixture so that the shadow mask carried thereby rests upon and in the plane of the upper bonding surface 24 of the support frame 22, when said locating pins engage said reference holes formed in the support frame. Alternatively, as shown in FIGS. 6 and 6*a*, the temporary fixture may be provided with a plurality of V-blocks 38, positioned with the V-grooves 40 120° apart and also located at a fixed distance relative to the upper reference surface 42 of the fixture 34, so as to engage reference spheres 32 such that the shadow mask carried by the temporary fixture rests upon and is positioned in the plane of the upper bonding surface 24 of the support frame 22, when the V-blocks 38 are aligned and engaged with the spheres 32. Thus, the three holes 30 and locating pins 36, or the three spheres 32 welded to the frame 22 and the V-blocks 38, cooperate with one another to determine the position and plane of the flat shadow mask 26 when the temporary frame 34 is positioned over the support frame 22.

Figure 7:
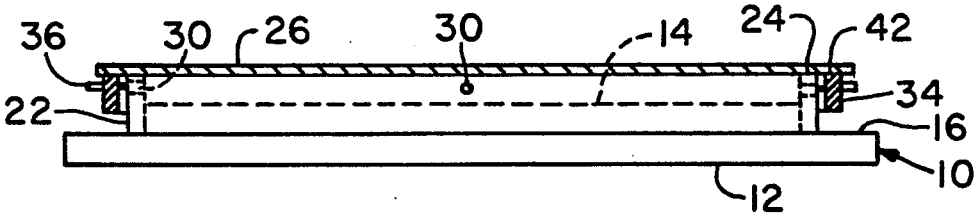
FIG. 7 is a schematic illustration, partially in section, showing the positionment of the temporary frame over the support frame, such as for lighthousing the phosphors or permanently attaching the tensioned shadow mask to the support frame upon completion of the application of the phosphors.

The temporary fixture 34 is of a larger perimeter than that of the support frame 22, so that it may conveniently be positioned thereover as shown in FIG. 7. However, prior to positioning the temporary fixture over the support frame, the shadow mask 26 is stretched across and secured under tension to the upper reference surface 42 of the temporary fixture. The particular method of tensioning the mask to the fixture may be varied as desired. For example, the mask may be mechanically stretched over the fixture 34, or it may be thermally tensioned by heating the same and securing it to the fixture prior to cooling. Further, the tensioned mask may be secured to the fixture by welding, bonding, banding, or by a plurality of mechanical clips or clamps. The shadow mask 26 may be formed from cold rolled steel, or invar, and preferrably has a thickness of about 0.001".

As can be appreciated from the foregoing description of the present reference system, a precise and repeatable kinematic registration between the shadow mask 26 and the target area 14 of the panel 10 is obtainable with the present system as shown in FIG. 7. Accordingly, the system functions as a stencil in the screening of the pattern of elemental phosphor deposits upon the target surface 14 of the panel 10 when utilizing known lighthouse procedures. As previously mentioned, the reference system, either between the holes 30 and pins 36 or spheres 32 and V-blocks 38, precisely and repeatably aligns the mask 26 with the same orientation and Q-spacing with reference to the target area 14, so that the shadow mask assembly can be removed and precisely reinserted as is required to apply the black matrix and phosphors to the target area 14 of the panel 10.

After the screening process is completed, the tension shadow mask assembly 35 can again be accurately relocated on the support frame 22, again with the same required orientation and Q-spacing, and the tensioned shadow mask is then welded to the upper bonding surface 24 of the support frame 22. The excess portion of the mask exterior of the support frame 22 is then severed, and the holding frame or fixture 34 is removed and reused. The configuration of the band or support frame 22, which is preferrably formed of steel, is designed to provide adequate support for the flat shadow mask 26, which is pretensioned and welded to the upper surface thereof. If desired, the band 22 may have "L" or "T" shaped cross-sections, and holes may be provided in the band adjacent the target area 14 to allow screening material to exit in the tube manufacturing process.

The reference and support system of the present invention is substantially more simplified and easier to produce than the complex systems of the prior art. For example, simple drilling and fixturing is all that is required to drill the location holes in the metal mask support frame, whereas before sophisticated ultrasonic drilling or milling into glass articles was required.

Although the now preferred embodiments of the invention have been disclosed, it will be apparent to those skilled in the art that various changes and modifications may be made thereto, such as by drilling the reference holes in the temporary fixture or securing the spheres or reference studs to the support frame, without departing from the spirit and scope of the invention as set forth in the appended claims.

We claim:

1. A CRT panel and mask assembly comprising:

a glass panel member having an outer surface and an inner surface;

said inner surface having a central target area surface portion and a sealing land, with said sealing land surrounding and being stepped with respect to said central target area surface portion;

a peripheral surface bounding said central target area surface portion and extending substantially perpendicular to said target surface portion, and being formed as a connecting wall between said stepped sealing land and said central target area surface portion;

a support frame snuggly positioned against said peripheral bounding surface;

said support frame having a bonding surface spaced from said central target area surface portion with a desired Q-spacing; and a pretensioned flat shadow mask secured to said bonding surface.

2. A CRT panel and mask assembly comprising:

a glass panel member having an outer surface and an inner surface;

said inner surface having a central target area surface portion;

a peripheral surface bounding said central target area surface portion and extending substantially perpendicular to said target area surface portion;

a metal support frame shrunk fit onto said peripheral bounding surface to form an implosion protection system;

said support frame having a bonding surface spaced from said central target area surface portion with a desired Q-spacing; and a pretensioned flat shadow mask secured to said bonding surface.

3. A CRT panel and mask assembly comprising:

a panel member having an outer surface and an inner surface;

said inner surface having a central target area surface portion;

a peripheral surface bounding said central target area surface portion and extending substantially perpendicular to said target area surface portion and being formed by a continuous groove in said panel member positioned peripherally of said central target area surface portion;

a support frame snuggly positioned against said peripheral bounding surface;

said support frame having a bonding surface spaced from said central target area surface portion with a desired Q-spacing, and a portion of said support frame opposite said bonding surface being positioned within said continuous groove; and a pretensioned flat shadow mask secured to said bonding surface.

4. A CRT panel and mask assembly comprising:

a panel member having an outer surface and an inner surface;

said inner surface having a central target area surface portion;

a peripheral surface bounding said central target area surface portion and extending substantially perpendicular to said target area surface portion;

a support frame snuggly positioned against said peripheral bounding surface;

said support frame having a bonding surface spaced from said central target area surface portion with a desired Q-spacing;

a sealing land formed on the inner surface of said panel member surrounding the outer periphery of said support frame; and a pretensioned flat shadow mask secured to said bonding surface.

5. A CRT panel and mask assembly as defined in claim 4 wherein said support frame is frit sealed to said inner surface of said panel member peripherally about said central target area surface portion.

6. A CRT panel and mask assembly comprising:

a panel member having an outer surface and an inner surface;

said inner surface having a central target area surface portion;

a peripheral surface bounding said central target area surface portion and extending substantially perpendicular to said target area surface portion;

a support frame snuggly positioned against said peripheral bounding surface;

said panel member being stepped on its inner surface so as to provide said peripheral bounding surface about said target area surface portion and so as to provide a sealing land surrounding the outer periphery of said support frame;

said support frame having a bonding surface spaced from said central target area surface portion with a desired Q-spacing; and a pretensioned flat shadow mask secured to said bonding surface.

* * * * *